US011142394B1

(12) United States Patent
DeLong

(10) Patent No.: US 11,142,394 B1
(45) Date of Patent: Oct. 12, 2021

(54) BULKHEAD SECUREMENT SYSTEM AND METHOD FOR INTERMODAL SHIPMENT OF DRY FLOWABLE COMMODITIES

(71) Applicant: The DeLong Co., Inc., Clinton, WI (US)

(72) Inventor: William P. DeLong, Clinton, WI (US)

(73) Assignee: The DeLong Co., Inc., Clinton, WI (US)

( * ) Notice: Subject to any disclaimer, the term of this patent is extended or adjusted under 35 U.S.C. 154(b) by 0 days.

(21) Appl. No.: 17/302,285

(22) Filed: Apr. 29, 2021

(51) Int. Cl.
*B65D 90/00* (2006.01)
*B65D 88/12* (2006.01)

(52) U.S. Cl.
CPC ..... *B65D 90/0053* (2013.01); *B65D 88/121* (2013.01)

(58) Field of Classification Search
CPC ..... B65D 90/0053
USPC ..... 410/117, 118, 121, 129
See application file for complete search history.

(56) References Cited

U.S. PATENT DOCUMENTS 4,054,226 A * 10/1977 Bjelland ..... B65D 90/047 220/1.6
4,186,845 A * 2/1980 Podd ..... B65D 90/046 206/524.2
4,436,466 A * 3/1984 Marino ..... B61D 45/001 410/118
4,784,287 A * 11/1988 Yamada ..... B65D 90/047 220/1.5
5,152,735 A * 10/1992 Podd, Jr. ..... B65D 90/047 493/100
5,421,476 A * 6/1995 Matias ..... B65D 90/048 220/1.5
5,454,685 A * 10/1995 Podd, Jr. ..... B60P 1/38 414/527
5,657,896 A * 8/1997 Matias ..... B65D 90/048 220/1.6
6,206,623 B1 * 3/2001 Podd ..... B60P 7/14 220/1.5
7,506,776 B2 * 3/2009 Podd ..... B65D 90/046 220/1.6
7,516,863 B2 * 4/2009 Siegers ..... B65D 90/048 220/1.6
8,459,916 B2 6/2013 Widynowski et al.
(Continued)

OTHER PUBLICATIONS

Bulkheads & Norseman Bracing System, Information Sheet, Norseman, Date Unknown, 1 p.
(Continued)

*Primary Examiner* — Hilary L Gutman
(74) *Attorney, Agent, or Firm* — Neal, Gerber & Eisenberg LLP

(57) ABSTRACT

The invention provides a disposable bulkhead for use with containing dry flowable commodities inside an intermodal container. The invention involves supporting a custom-fit cardboard ply bulkhead across the rear of an intermodal container using tension straps arranged to position resistant force at desired locations where pressure against the bulkhead is greatest, while utilizing existing eyelet anchors fixed to the interior of the intermodal container. Breakaways are provided to simplify release of the bulkhead. Straps are positioned to secure the cardboard ply against the interior sidewalls of the container.

20 Claims, 11 Drawing Sheets

(56) References Cited

U.S. PATENT DOCUMENTS

2008/0181742 A1 7/2008 Dry et al.

OTHER PUBLICATIONS

Door Bulkhead, Specification Sheet, SuperTex, Date Unknown, 2 pp.
Grain Bulkhead 2, YouTube Video dated May 5, 2013, obtained from website https://www.youtube.com/watch?v=ToQ9TXzugD0 on Mar. 30, 2021, 5 pp.
OR-T 130, OR-T 260, OR-T 450, Operating Instructions, Orgapack, 2017, 28 pp.

* cited by examiner

BULKHEAD SECUREMENT SYSTEM AND METHOD FOR INTERMODAL SHIPMENT OF DRY FLOWABLE COMMODITIES

TECHNICAL FIELD

This invention relates generally to logistical shipment systems and methods, and more specifically, for systems and methods used in association with the shipment of dry flowable commodities, such as, for example, corn, rice, soybeans, malt, barley and other bulk grains.

BACKGROUND

Grain and other dry flowable commodities are shipped around the world from where they are harvested and plentiful to places where they are in demand on a daily basis. For example, wheat and grain grown in the American midwest are frequently shipped to China. While domestic transport is typically done by loading the commodities from large silos into open-topped railroad cars, international transport requires the use of covered, stackable intermodal containers that typically must be end-loaded. The grain (for example) is not boxed or separately contained, but rather poured onto the floor of the container. Because of the nature of the "flowable" material, as it piles up it spreads out and would eventually spill out the loading doors on the end of the container. Thus, a bulkhead, or brace, is positioned just inside the doors to hold the grain in place and allow the doors to close. The bulkhead serves the additional purpose of helping keep the grain from moisture that may seep under or around the doors during oversea shipment.

Traditionally, and for many years, bulkheads have been supported with long wooden boards, such as 2"×6" boards cut to fit across the width of the container. The boards extend across the width of the intermodal container and stack just inside the door. While effective, this can be expensive depending on the cost of wood. There is typically no recovery of the materials used to create or support the bulkhead. Once the shipping container reaches its destination, the bulkhead is disassembled and discarded or put to other uses, but is not returned to the entity that shipped the commodities. Moreover, removal of the boards at the destination may be difficult due to the pressure of the grain (or other commodity) pushing against them and pinning them to the rear frame edges of the container.

SUMMARY OF THE INVENTION

The present invention solves these issues by providing a relatively simple, yet unique bulkhead securement system that has evaded commodity shippers for decades. In essence, the system and methods disclosed involve using a custom fit bulkhead supported by a series of tension straps designed to place maximum support for the load at points where the load is the highest, while using available eyelet anchor points on most intermodal containers.

In some instances, the invention discloses a system for maintaining separation between dry flowable commodities loaded within an intermodal shipping container and loading doors at an end of the intermodal container that comprises a cardboard ply positioned near the end of the intermodal shipping container and slightly inset from the loading doors, the cardboard ply extending from a left interior wall of the intermodal shipping container to a right interior wall of the shipping container, and extending from a floor of the intermodal shipping container toward a ceiling of the intermodal shipping container; a first tension strap extending diagonally from a first lower eyelet fixed to the left interior wall proximate the floor of the intermodal shipping container to a second upper eyelet fixed to the right interior wall at a height approximately halfway between the floor and the ceiling of the intermodal shipping container; and a second tension strap diagonally extending from a second lower eyelet fixed to the right interior wall proximate the floor of the intermodal shipping container to a first upper eyelet fixed to the left interior wall at a height approximately halfway between the floor and the ceiling of the intermodal shipping container; wherein the first tension strap crosses the second tension strap at a midpoint between the left interior wall of the intermodal shipping container and the right interior wall of the intermodal shipping container and below an upper edge of the cardboard ply, and wherein the first and second tension straps are positioned between the cardboard ply and the loading doors of the intermodal shipping container.

In other instances, the invention discloses a method for maintaining separation between dry flowable commodities loaded within an intermodal shipping container and the loading doors at an end of the intermodal container comprising the steps of (1) positioning a bulkhead near the rear of the intermodal shipping container and slightly inset from the loading doors such that the bulkhead extends from a left interior wall of the intermodal shipping container to a right interior wall of the shipping container, and extends from a floor of the intermodal shipping container toward a ceiling of the intermodal shipping container (2) extending a first tension strap diagonally from a first lower eyelet fixed to the left interior wall proximate the floor of the intermodal shipping container to a second upper eyelet fixed to the right interior wall at a height approximately halfway between the floor and the ceiling of the intermodal shipping container; and (3) extending a second tension strap diagonally from a second lower eyelet fixed to the right interior wall proximate the floor of the intermodal shipping container to a first upper eyelet fixed to the left interior wall at a height approximately halfway between the floor and the ceiling of the intermodal shipping container, such that the first tension strap crosses the second tension strap at a midpoint between the left interior wall of the intermodal shipping container and the right interior wall of the intermodal shipping container and below an upper edge of the bulkhead, and such that the first and second tension straps are positioned between the bulkhead and the loading doors of the intermodal shipping container.

As will be understood and appreciated by those of skill in the art from a review of the full written description below, variations may be made to the strapping described above in some embodiments, and additional components or steps may be used in some particular embodiments. For example, some embodiments may involve tensioning the straps and applying friction welds to hold their ends together. Other embodiments may include preparation of the cardboard ply and/or bracing the base of the load with a water resistant block. Still other embodiments and/or features are identified in the disclosure and claims below, in combination with the associated figures.

BRIEF DESCRIPTION OF THE DRAWINGS

The present invention can be better understood with reference to the following drawings. The components in the drawings are not necessarily to scale, emphasis instead being placed upon clearly illustrating the principles of the present invention. Where dimensions are provided, they are used for reference and understanding, and are not limiting unless the feature in question expressly claimed to be of a particular dimension. In the drawings, like reference numerals designate corresponding parts throughout the several views.

DETAILED DESCRIPTION

The description that follows describes, illustrates and exemplifies one or more particular embodiments of the present invention in accordance with its principles. This description is not provided to limit the invention to the embodiments described herein, but rather to explain and teach the principles of the invention in such a way to enable one of ordinary skill in the art to understand these principles and, with that understanding, be able to apply them to practice not only the embodiments described herein, but also other embodiments that may come to mind in accordance with these principles. The scope of the present invention is intended to cover all such embodiments that may fall within the scope of the appended claims, either literally or under the doctrine of equivalents.

This invention relates to the shipment of dry flowable commodities, which can be of a variety of types such as corn, soybeans, wheat, rice or other lentils or grains as well as animal feed products such as DDGS, soybean meal, corn gluten meal, etc. It could also be used with the shipment of small particulate materials that spread laterally in all directions when piled up, such as dirt, pea gravel and other loose materials. One of skill in the art would understand that certain adjustments may need to be made to the load specifications and materials described herein depending on the density/weight of the particulate to be contained. For the purpose of describing the invention, we use simply "grain" as a surrogate for all dry flowable materials such as those described above, with the understanding that the invention is not limited to the containment of grain.

Grain is typically shipped internationally in intermodal containers. These are generally standard-sized containers configured to attach to a container chassis for hauling by truck over road as well as a container car for rail transport. They can be moved from truck to rail and vice versa using overhead cranes, and also lock in to one another for purposes of stacking on ocean ships. The containers are typically 40', 45' or 53' feet in length, 8' feet wide and either 8'6" or 9'6" (high cube) feet tall, exterior dimensions. They are constructed of steel, and feature ribbing along the sides for extra support.

Figure 1:
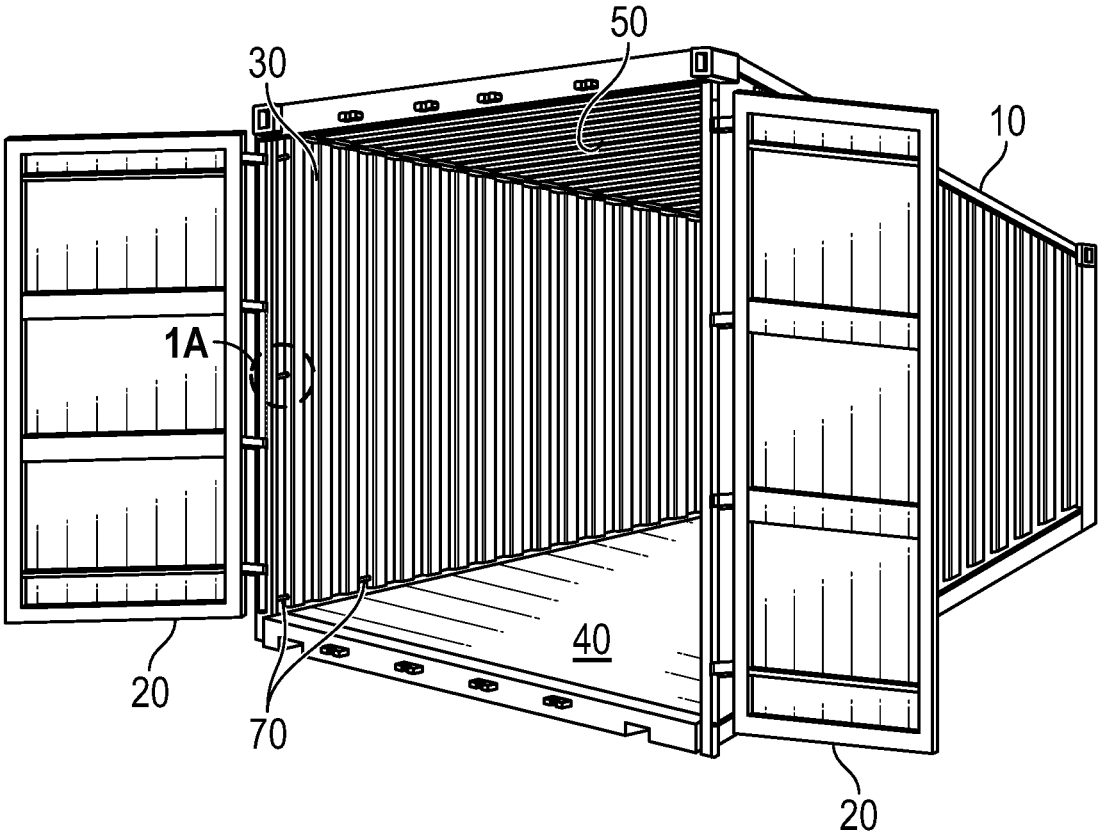
FIG. 1 (Prior Art)
FIG. 1 is an isometric view of an empty intermodal shipping container with the loading doors open, as known in the prior art.
Figure 1A:
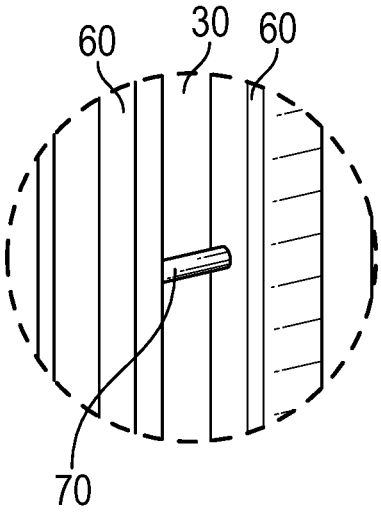
FIG. 1A (Prior Art)
FIG. 1A is an exploded view of an eyelet anchor fixed to an interior wall of the prior art intermodal shipping container of FIG. 1.

FIG. 1 shows a standard intermodal shipping container 10 from an end view, where the loading doors 20 are opened to allow the container to be filled. As shown, the container features a flat loading floor 40, a ceiling 50, and left and right sidewalls 30. The sidewalls and ceiling are reinforced with ribs 60 that pass circumferentially around the container and under the floor 40. Tie down features may be located at various points throughout the intermodal container. As shown in FIG. 1, and more clearly in the closeup of FIG. 1A, the containers used in the present invention include three anchor points (also called "u-channels" in the art, but referred to herein as "eyelets") that each consist of a horizontal steel rod (e.g., eyelet 70) spanning two vertical ribs 60, and inset from an interior sidewall 30 of container 10. One eyelet 70 is a few inches off the loading floor 40, another is near the ceiling 50, and a third eyelet 70 is approximately between these two. These three eyelets are located just inside the loading doors 20 on both sides 30 of container 10, thus six eyelets 70 total. The eyelets near the ceiling need not be used in the present invention. Thus, the eyelets of interest are referred to herein as the lower and upper eyelets, where the "upper" eyelet refers to the one in the middle. The designations "L" and "R" in the figures (such as 70L and 70R) refer to left and right taken from the perspective of a rear view of the container, such as in FIG. 1.

Those of skill in the art will appreciate that some containers have four eyelets 70 along the ribs 60 just inside each loading door 20, equally spaced such that there is no eyelet in the vertical center of the container, but rather one about 12" up from the vertical center and one about 12" down from the vertical center. Where such containers are to be used, either of these eyelets can be used as the "upper eyelet," where the optimal choice will depend on the amount of grain to be filled and the weight distribution.

Figure 2:
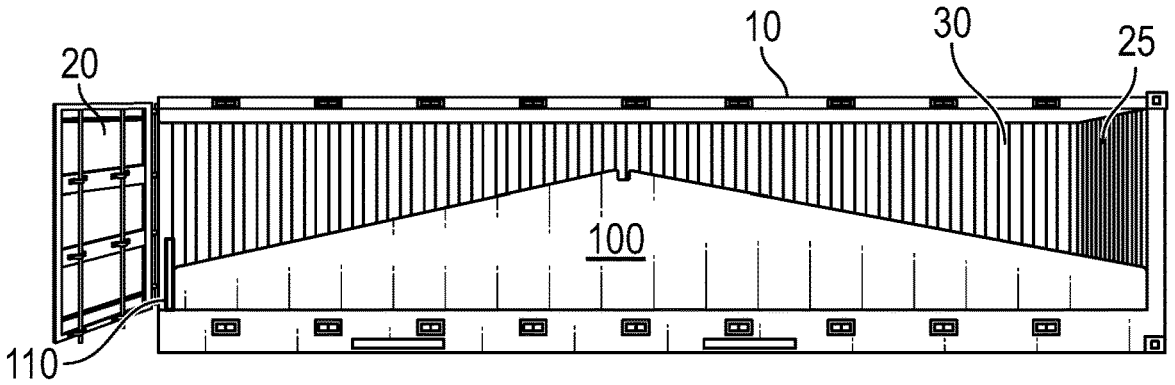
FIG. 2 (Prior Art)
FIG. 2 is a side view of the prior art intermodal shipping container of FIG. 1 loaded with grain and cutaway on one side to show certain internal features.

Notably, the grain cannot be filled through the top of the container because there is no opening. Rather, a conveyer is inserted through the open loading doors 20 and into the interior of the container along its ceiling 50. Grain is then deposited onto the floor 40. The result is a pile of grain highest in the center and lowest at the ends, as shown in FIG. 2. FIG. 2 depicts a side view of an intermodal container with grain loaded and a side removed to show the load distribution. As the grain fills, it presses out against the sides 30 of the container 10, and its closed end wall 25. But because the loading doors are opened, a bulkhead 110 must be installed prior to loading the grain to provide a barrier to prevent grain from spilling out the end with the open loading doors 20. The conveyer (not shown) is inserted over the top of the bulkhead 110 to load the grain, thus the bulkhead 110 cannot extend all the way to the ceiling. And it need not do so because the grain will only fell a few feet up from the floor at the container ends.

Imagined in three dimensions, it will be appreciated that the load against the bulkhead 110 is greatest at its base (where it extends from the container floor 40), and at its center. The weight of the grain against it decreases as you move vertically, and laterally to the sides. Thus, more resistive force is required at the lower center than at other places along the bulkhead to keep it in place during loading and shipping.

A properly installed bulkhead 110 allows the loading doors 20 to close, and also provides an air gap between the bulkhead and the loading doors during shipment. Often the seals on the doors wear over time and allow some intrusion of moisture during ocean transit. Preferably this is kept away from the grain in order to prevent mildew and spoilage, so the bulkhead 110 also serves this purpose. At the designation side, the loading doors 20 are opened without grain spillage because the bulkhead is still in place. The bulkhead is then cut away or otherwise removed allowing the grain to be emptied largely by force of gravity.

As explained in the background section above, traditional bulkhead systems use wooden boards for support. Others, such as that shown at bulk-liner.com/products/door-bulkhead, use steel bars. Both of these are expensive and, while re-usable, typically are not returned to the entity that prepared and shipped the grain. Rather, the materials are either repurposed or disposed of at the receiving end, resulting in a loss for the shipper. Moreover, they can be difficult to disassemble once the weight of the grain has settled against the bulkhead.

Figure 3:
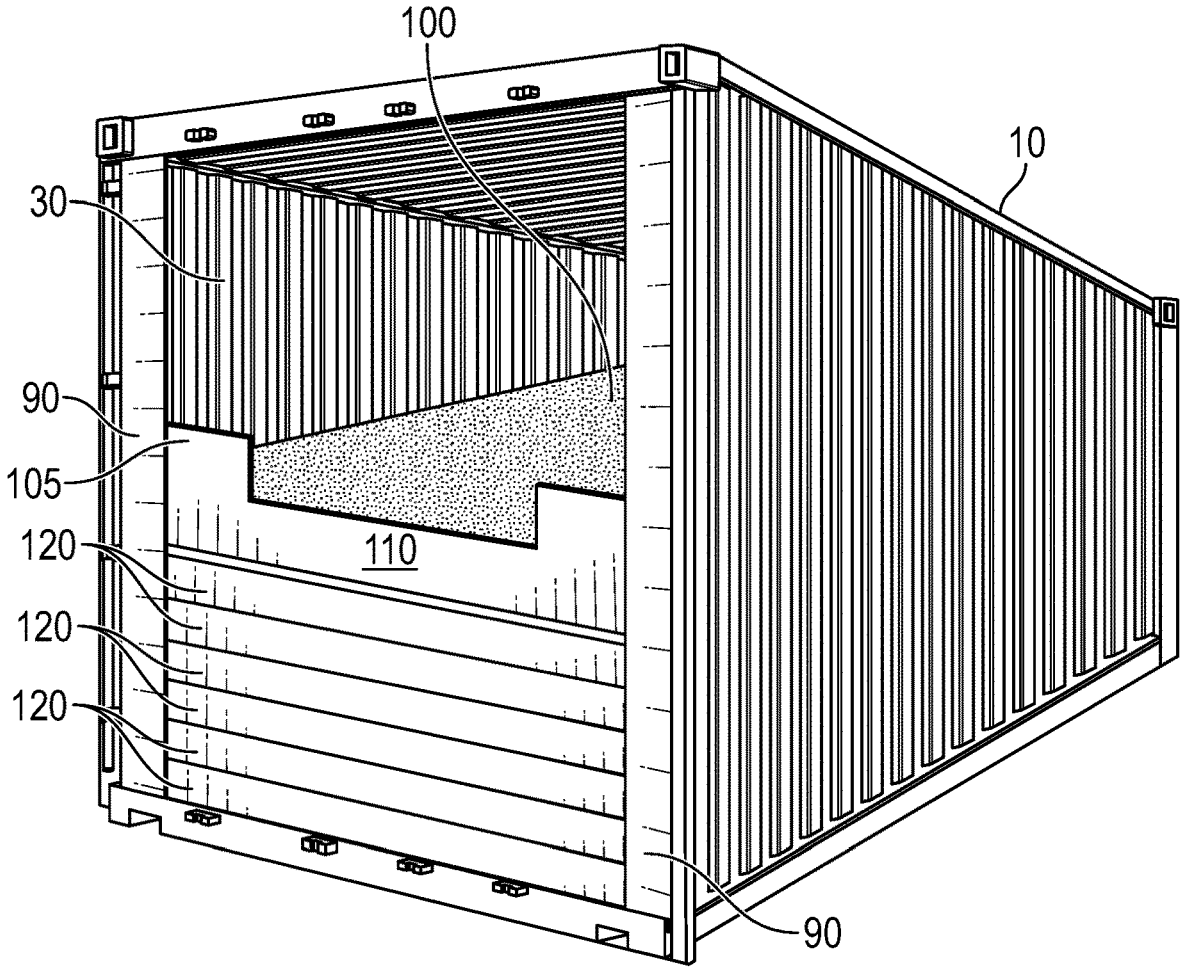
FIG. 3 (Prior Art)
FIG. 3 is an isometric view of the intermodal shipping container of FIG. 2 showing the end of the container with a traditional bulkhead in place.

FIG. 3 shows an isometric rear view of an intermodal container 10 loaded with grain 100 and a traditional bulkhead system 110 in place. The system is typically comprised of a cardboard ply 105 braced into place by a series of wood planks 120—typically 2×6 boards—stacked behind the cardboard and pressing against the door frame 90 of the container at either side. While sufficiently sturdy, this design is inefficient in that it does not focus resistive force at the locations where the load of the grain is greatest, but rather evenly distributes it across the back of the container. It also is relatively expensive, and carries with I market fluctuations in the price of lumber. It is heavy to load, and can be difficult to unload on the far end. The boards 120 must be unloaded one at time, each one allowing the grain level to drop slightly in order to take pressure off the next lower board to allow it to be lifted out. Even then, sometimes the boards 120 become stuck or have to much weight against them such that they must be cut out.

It will be understood that various materials can be used for the bulkhead that holds the grain back. The term "ply" is used herein to describe the bulkhead, and is not limited to any particular material. Particularly because the materials are seldom returned, there is a desire to reduce the cost of the ply as much as possible, so cardboard is often used. The thickness and specifications of the cardboard can be reduced as material used to support it (wood, steel bars, etc.) becomes more robust and provides more touch points.

Figure 4:
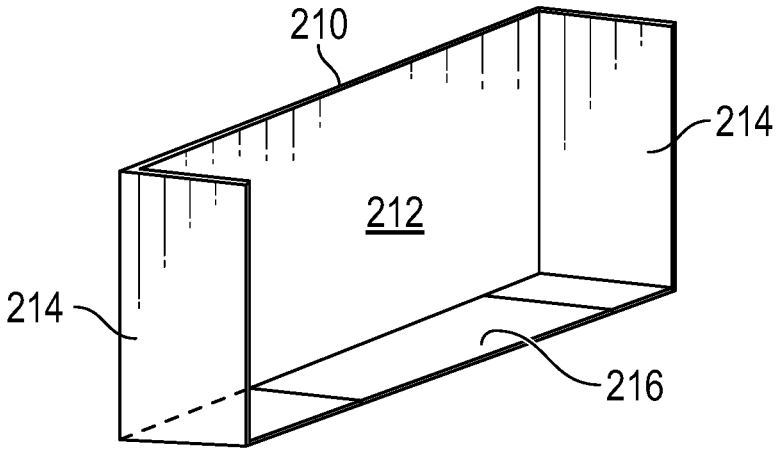
FIG. 4 is a perspective view a form-fitted cardboard ply, in accordance with certain embodiments of the present invention.
Figure 5:
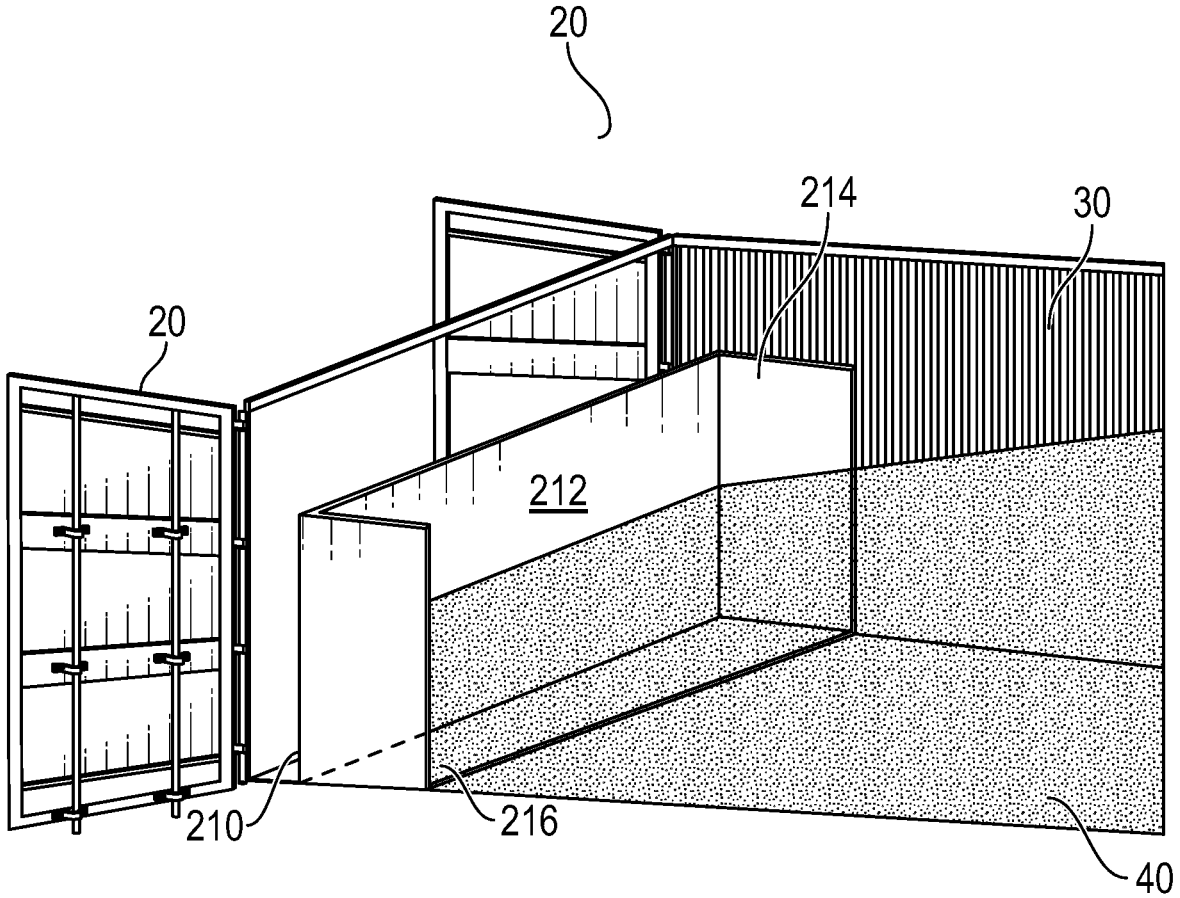
FIG. 5 is a perspective view showing a cutaway of an intermodal shipping container with the form-fitted cardboard ply loaded in place and holding back a load of grain.

FIG. 4 shows a custom fit cardboard ply 210 such as used in the present invention. The ply 210 comprises a backwall 212 that extends across the width of an intermodal container 10 from one sidewall 30 to the other. The ply 210 is folded in at the sides and under at the bottom to form short side extensions 214 and a bottom stand 216 that sits on the floor 40 of container 10. The side extensions 214 and bottom stand 216 are folded forward (away from the loading doors 20 of the container) so as to fit along the edges of the container walls 30 and floor 40 to minimize the amount of grain seeping under or around the ply 210. The ply 210 may be shipped flat and then folded to this shape prior to installation in the container 10. As shown in FIG. 5, the ply 210 has been positioned within and at the back of a storage container 10 in order to hold grain 100 in place. What is not shown in this cut-away perspective view from the front side of the container is the supporting features that hold the cardboard ply 210 in place.

Figure 6:
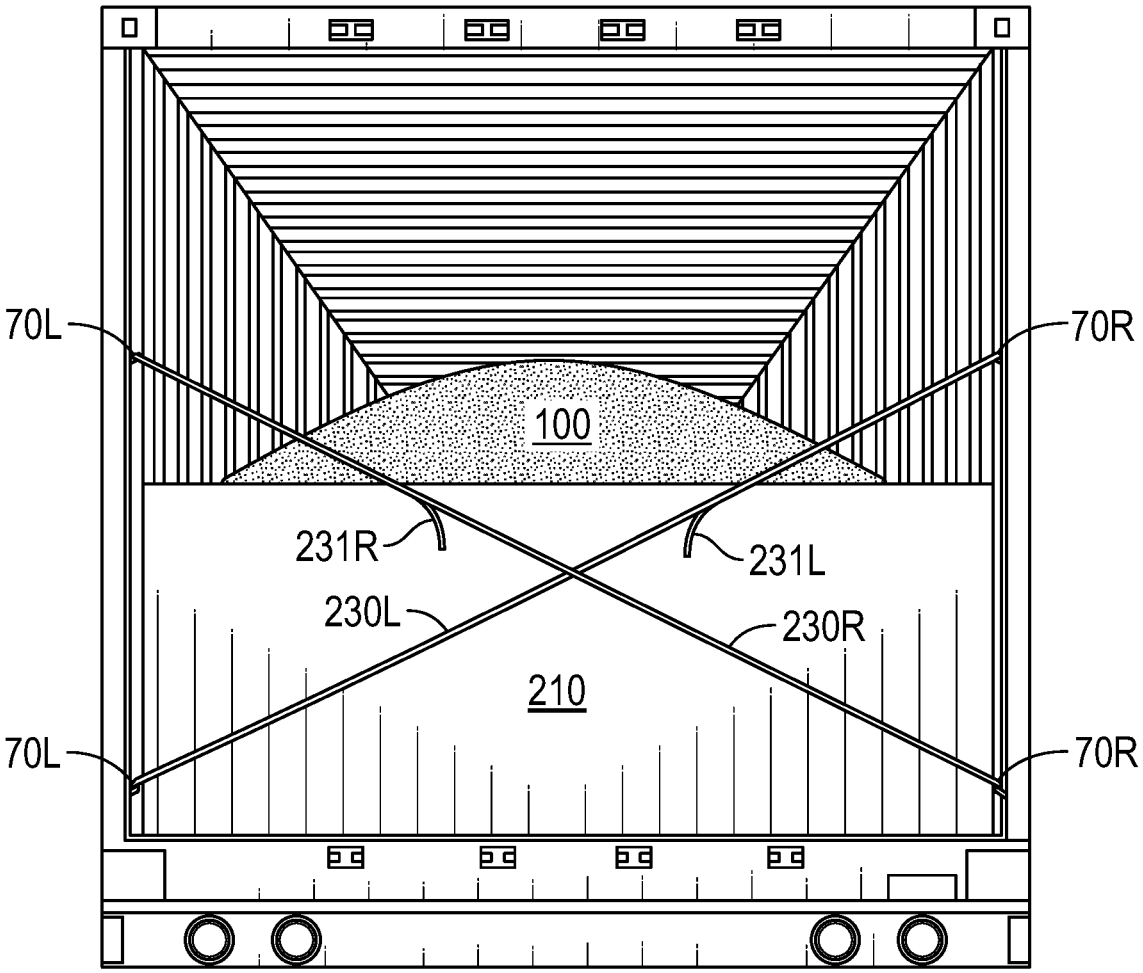
FIG. 6 is a partial rear view of an open intermodal shipping container showing a tension strap configuration supporting the cardboard ply in accordance with certain embodiments.

FIG. 6 shows the other side of the ply 210, with bracing in place in accordance with a first embodiment of the present invention. Here, the ply 210 is holding back a load of grain 100 within container 10, and is supported by a strapping system. Specifically, two separate straps are employed, designated 230L and 230R. Strap 230L runs around lower eyelet 70L and upper eyelet 70R, while strap 230R runs around upper eyelet 70L and lower eyelet 70R. While other materials such as cloth or nylon can be used, the preferred embodiment shown involves use of polyester straps approximately 0.75" in width and 0.04" thick. These straps are much lighter and less expensive than steel straps, can be joined quickly, and can resist tensile loads over 1500 lbs. without breaking.

Figure 9:
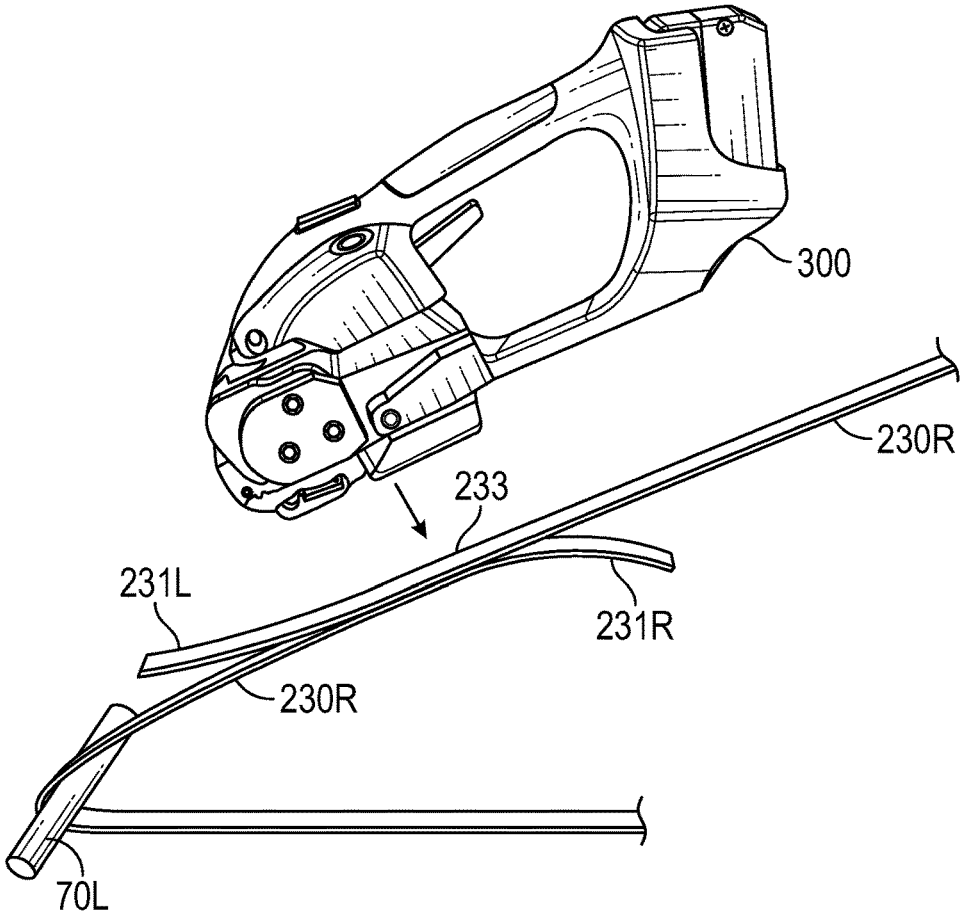
FIG. 9 is an exemplary illustration showing the joining of tension straps in association with the present invention.
Figure 9A:
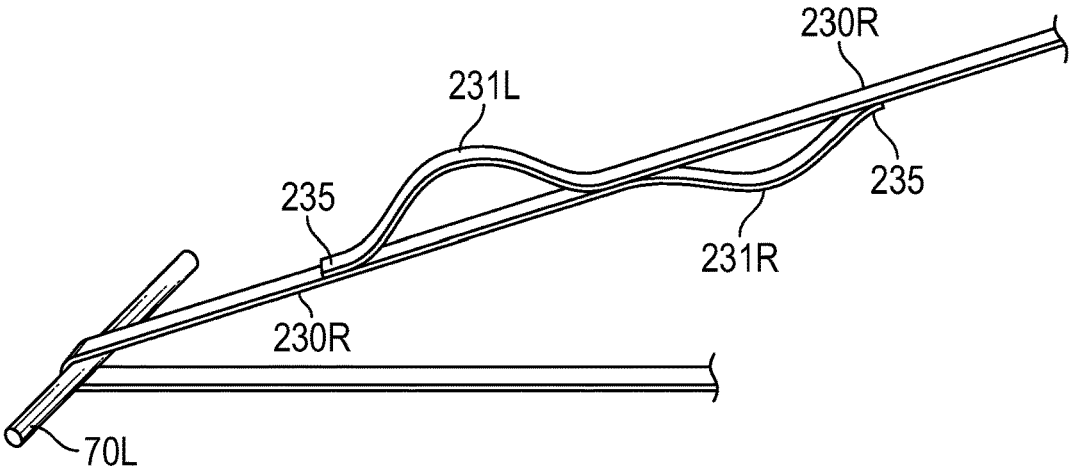
FIG. 9A is another exemplary illustration showing the joining of tension straps in association with the present invention.

Each strap (230L, 230R) has two ends that are joined together using a tensioning device 300 such as the OR-T 450 offered by U-Line® or the P329 by Fromm. This device 300 pulls the ends of a strap (e.g., 230L) together to a desired tension and then friction welds them together, such that the tension remains in the lines. Ideally, the tensioning device 300 leaves a free end of the strap that is unloaded beyond the point 233 where the ends are welded, as indicated in FIG. 9 by unloaded ends 231L and 231R. In some embodiments, a second friction weld 235 may be applied to connect the distal end of these unloaded free ends (231L, 231R) back to the main strap, as shown in FIG. 9A, so as to provide a secondary backup in case the primary friction weld fails. Either way, the free ends (231L, 231R) may be useful in releasing the straps at the destination. Even if pulling on free end 231L does not break the friction weld holding the ends of strap 231L together, it will weaken the weld and make cutting of the strap to release the grain easier.

It will be understood that the order of installing the straps (i.e., whether left or right is first) is not important, so long as the straps 230 are installed after the cardboard ply 210 is in place and before the grain 100 is loaded. It further does not matter which of the straps 231L or 231R crosses aft (e.g., closer to the loading doors 20) of the other, or where along their length the strap ends are bonded together. What results in the simple embodiment of FIG. 6 is a cheaper, lighter, and quicker to install and uninstall bulkhead system that still provides support at the center of the cardboard ply 210 where the weight concentration of grain is the highest. However, this system can be improved in other embodiments that place greater resistance at the bottom of the cardboard ply 210 without significantly increasing the amount of strapping used (and hence the cost).

Figure 7:
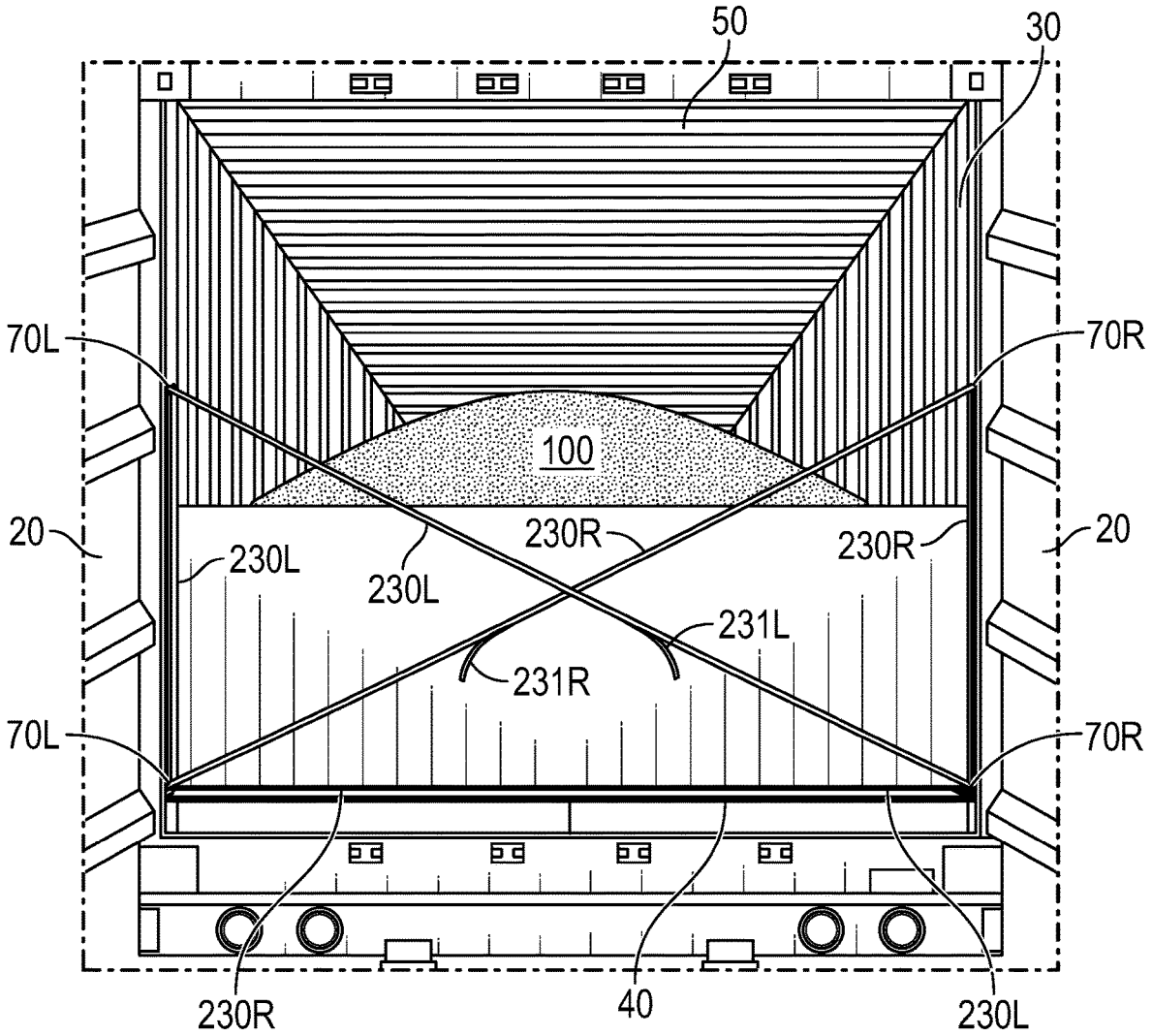
FIG. 7 is a rear view of the intermodal shipping container of FIG. 6 showing a second tension strap configuration supporting the cardboard ply in accordance with certain other embodiments.

For example, FIG. 7 shows another embodiment of the present invention that provides for placement of two additional strap lengths across the lower portion of the cardboard ply, while still presenting the cross in the center. This uses only slightly more strap material, but does a better job of positioning resistance across the bottom of the cardboard ply, where the load is heaviest. In this embodiment, Straps 230L and 230R each form opposing right tingles, crossing in the middle with a single length each, then forming vertical legs along respect sidewalls 20L and 20R, and finally running just above the floor 40 across the loading end of the container. More specifically, an end of tension strap 230L passes over upper eyelet 70L, down around lower eyelet 70L, across the container floor 40 and around lower eyelet 70R, then back to be joined to the other end of the tension strap. Meanwhile, an end of tension strap 230R passes over upper eyelet 70R, down around lower eyelet 70R, across the container floor 40 the other direction and around lower eyelet 70L, and back to be joined to the other free end of strap 230R.

Figure 7A:
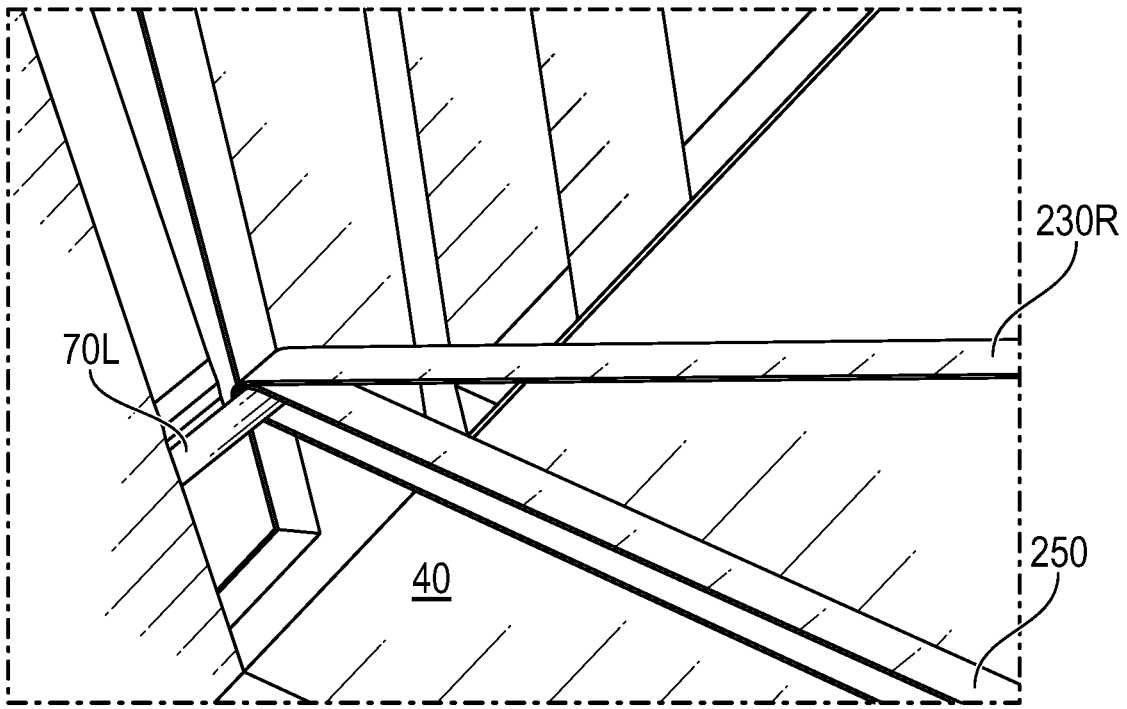
FIG. 7A is a closeup view of an eyelet anchor showing tension straps held in place.

The design of FIG. 7 not only performs a reinforcing cross in the center of the load, it also provides two lengths of tensioned straps just a few inches off of the floor 40 of the container 10, where load from the grain 100 is the highest. Once again the order of which strap is installed first or in front of the other does not matter. As shown in FIG. 7A, the straps may overlap when passing around the eyelets, or may be spaced one in front of the other. The eyelet is long enough to accommodate two separate strap lengths without them overlapping.

Figure 8:
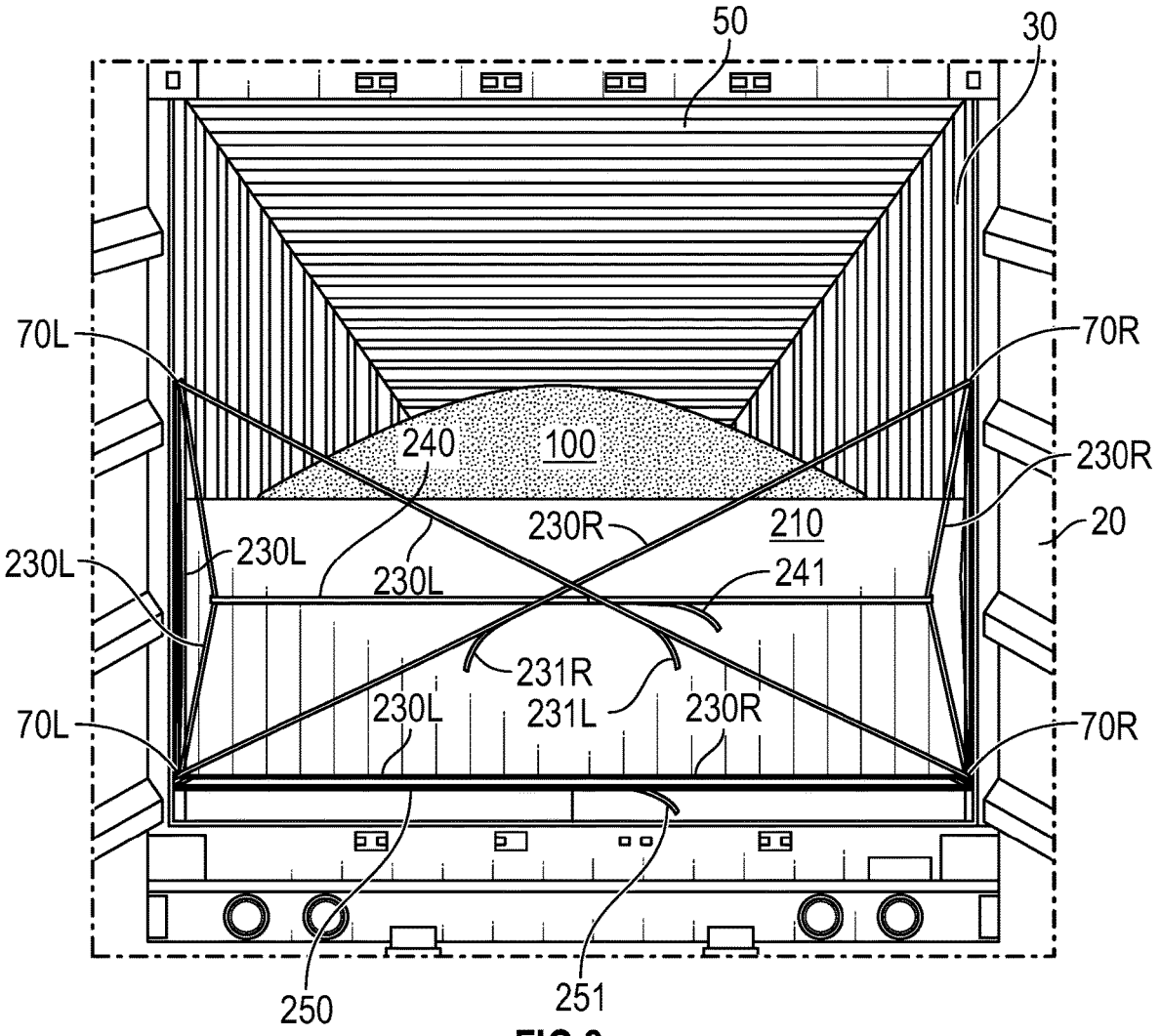
FIG. 8 is a rear view of the intermodal shipping container of FIG. 6 showing a second tension strap configuration supporting the cardboard ply in accordance with certain other embodiments.

FIG. 8 illustrates another benefit of the embodiment shown in FIG. 7. The positioning of the tension straps is somewhat limited by the location of the anchor eyelets 70, which are fixed to the sidewalls 20 of the container 10. Typically there are no eyelets 70 at a location, for example, 12" off the floor 40 of the container, so a tension strap may not pass across at this height. However, the strapping configuration of FIG. 7 allows an end of a middle horizontal tension strap 240 to be looped around the vertical leg of strap 230L on the left, and the vertical let of strap 230R on the right, and then drawn together and joined in the center. The tension applied to this middle horizontal strap 240 should be no more than a couple hundred lbs, and may be much less than the tension applied to straps 230L and 230R. This is because the strap 240 puts a side load on straps 230L and 230R. In this configuration, the joining of strap ends of 230L and of 230R should be along the diagonal length or the horizontal length along the floor 40 of the container—not along the vertical legs around which strap 240 passes.

It will be noted that middle horizontal strap 240 can be installed at essentially any height between the upper and lower eyelets, but is most effective when situated slightly below the halfway point, which is where straps 230L and 230R cross on the backside of the cardboard ply 210. Again, this positions resistance along the center of the cardboard ply 210 where the load from the grain is highest. Furthermore, installing strap 240 close to the upper eyelets may cause it to work its way down during transit to a point where there is more slack in the vertical legs, resulting in loss of tension in the middle horizontal strap 240.

As shown in FIG. 8, one may also apply a lower horizontal strap 250 across the bottom of the load, running from lower eyelet 70L to lower eyelet 70R. This strap can be installed first, such that the other straps can pass over it as they round the eyelets. See, for example, FIG. 7A, showing tension strap 250 rounding eyelet 70L on the inside, while tension strap 230R passes around the outside of it. Lower horizontal tension strap 250 is optional, but can provide additional load support across the bottom/base of cardboard ply 210. It will be understood that this lower horizontal strap 250 could also be applied to the strapping configuration of FIG. 6, which lacks the vertical legs and the ability to install the middle horizontal strap 240.

FIG. 9 is an isolation view showing a tensioning tool 300 joining ends of a given strap (230R in this case), which is looped around an eyelet (lower 70L in this case). The tensioner may be configured to trim off one of the free ends after the friction weld is applied, leaving the other in place (231R).

Figure 10:
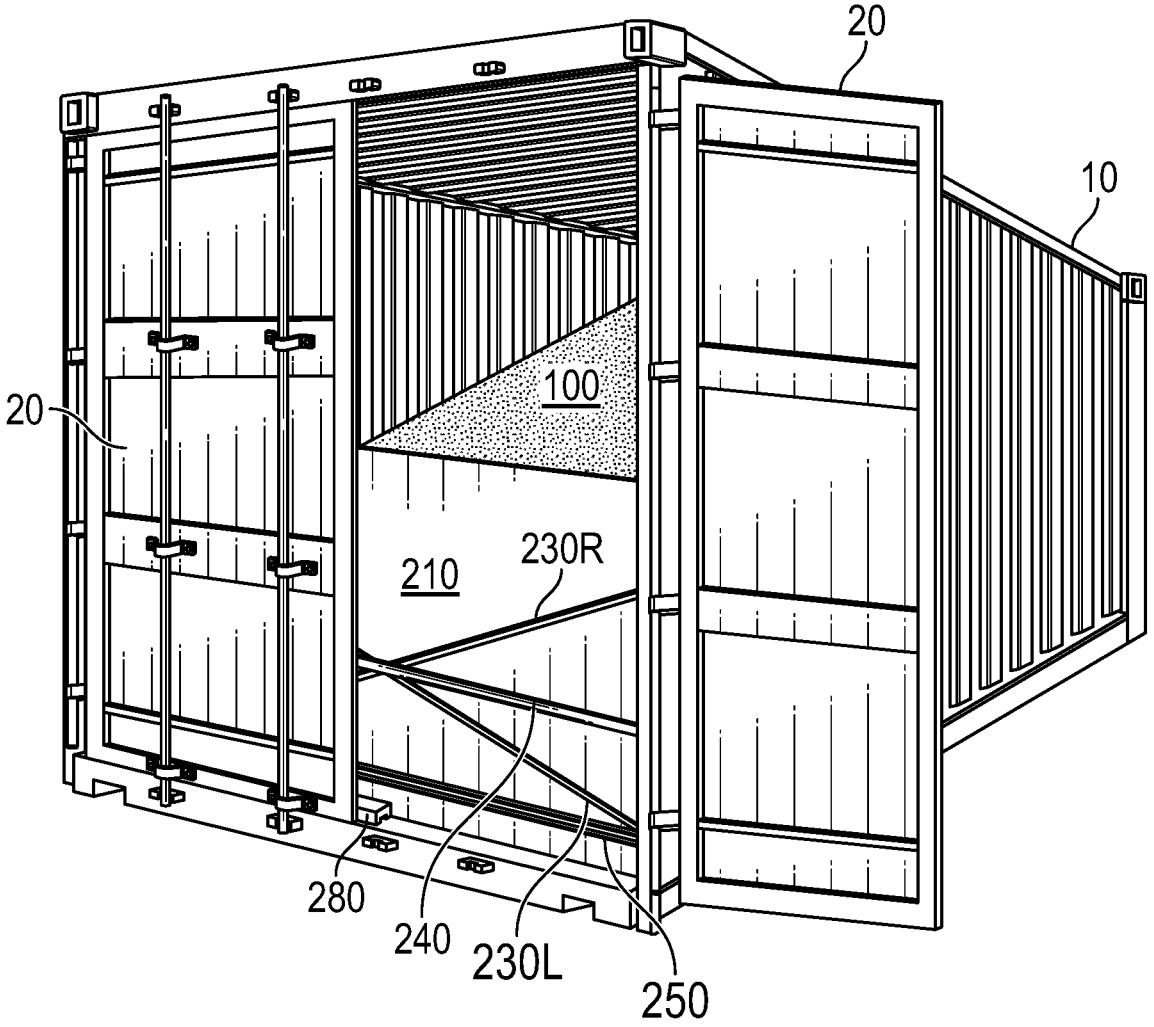
FIG. 10 is a perspective view of the intermodal shipping container in FIG. 7, showing a closed loading door and a bracing feature in place.

FIG. 10 shows a bulkhead system in place in accordance with the present invention. Grain 100 is loaded into container 10, and secured forward of the loading doors 20 by cardboard ply 210, which is in turn held in place by tension straps 230R, 230L and 240. In addition, a brace 280 is placed at the bottom, at the center of the load. The brace is sized to press fit between the cardboard ply 210 and the inside of the loading doors 20 to provide additional stand-off force right at the base of the load. This again helps prevent moisture from reaching and partially saturating the cardboard. Various materials can be used for the brace, such as wood, honeycomb reinforced cardboard, or even a water-resistant styrene or foam board.

Some smaller dry-flow materials tend to move or separate more during transit than others. In some cases, particularly where minor bowing occurs at the center of the bulkhead, the side extensions 214 may be pulled inboard enough that dry-flow particles work there way around the sides of the bulkhead, or even under the bottom stand 216. Even if a small amount relative to the overall load, this can cause spillage during inspection and make a mess. To help eliminate this, one or more additional straps can be utilized (herein called a forward strap) in order to help secure the bulkhead side extensions 214 against the interior walls 30 of container 10. This is made possible by utilizing a forward eyelet anchor 70F along the bottom of the interior wall. Typically these eyelets are formed just like the ones previously disclosed, but are located 6 to 8 inches forward of the lower eyelets 70 that are just inside the loading doors 20. However, the first forward eyelets may be several feet forward of the loading doors.

Figure 11:
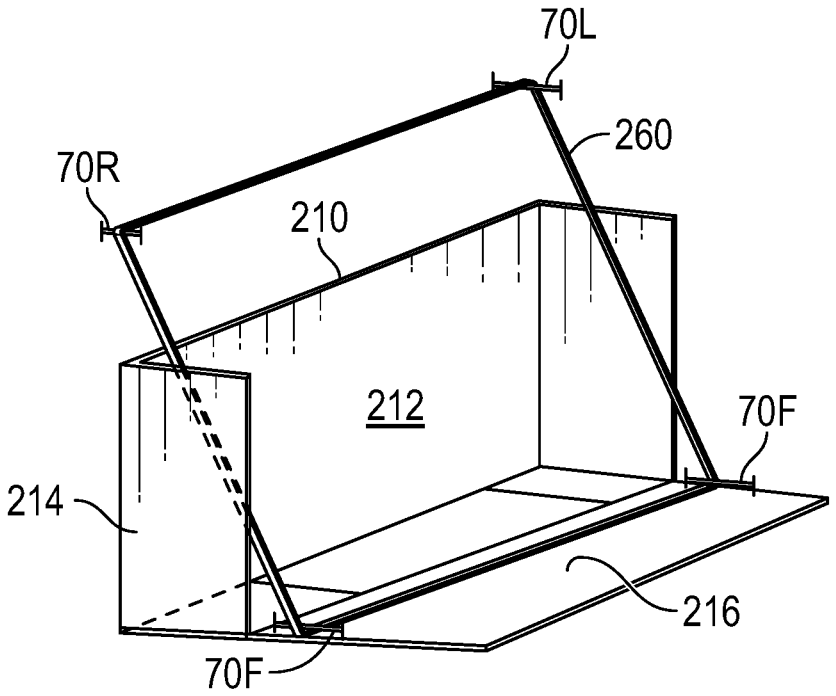
FIG. 11 is a perspective view of a different embodiment of form-fitted cardboard ply, showing a particular forward strap arrangement.
Figure 12:
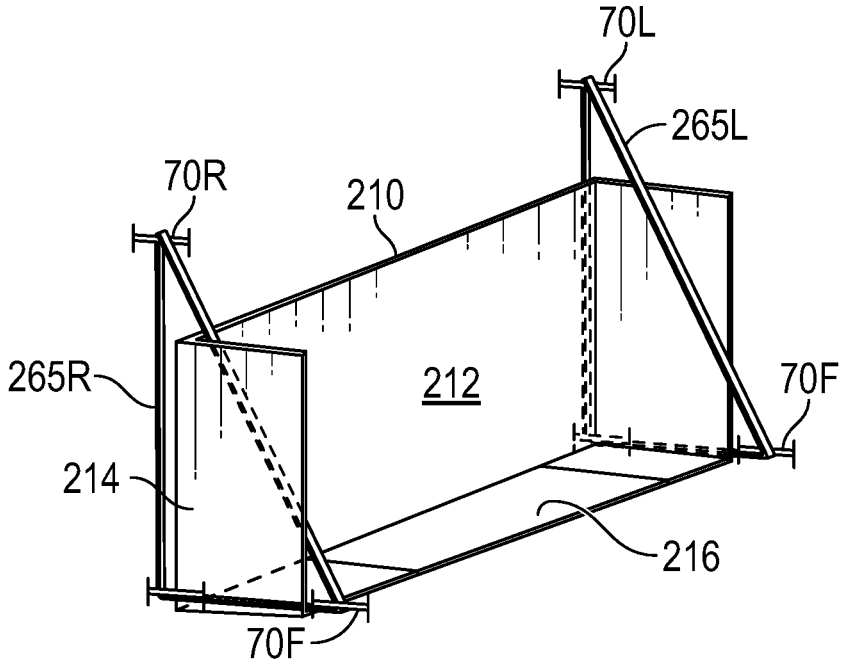
FIG. 12 is a perspective view of the form-fitted cardboard ply shown in FIG. 4, with an alternative forward strap arrangement.
Figure 13:
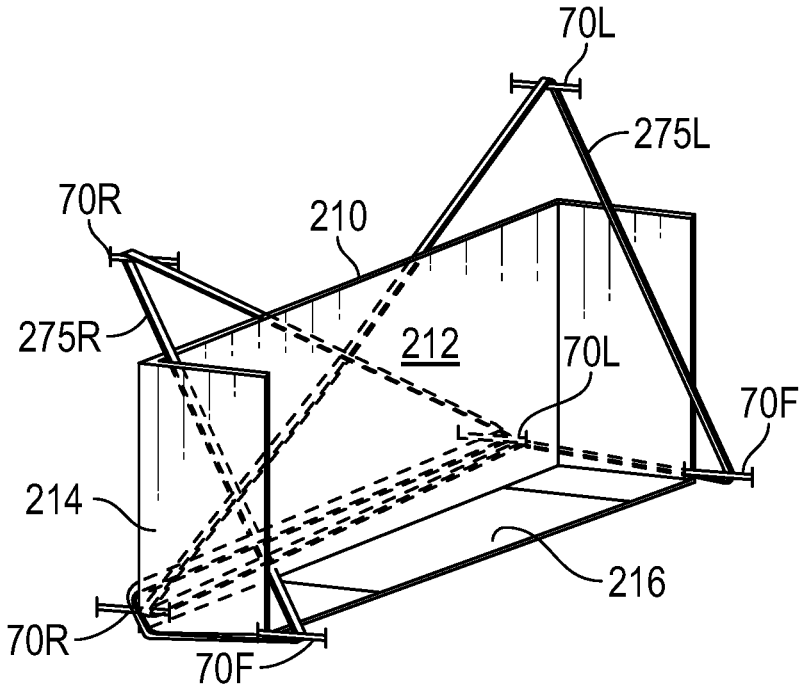
FIG. 13 is a perspective view of the form-fitted cardboard ply shown in FIG. 4, with another alternative forward strap arrangement.

FIGS. 11-13 illustrate configurations of forward straps using the forward anchors 70F. Though these figures do not show all or any of the straps on the other side of the cardboard ply 210, it will be understood that the forward straps would not be used in isolation, and that straps across the front face of backwall 212 are necessary to be used in tandem with the forward straps, such as the arrangements shown in FIGS. 6-8. In FIGS. 11-13 discussed below, the forward eyelet 70F is shown as being closer in to the back of the trailer—perhaps 8" inboard. As discussed above, this first forward eyelet 70F may be more like 40" into the trailer from the loading doors 20. In that case, while the same routing methods disclosed below can be used, they may be less effective because they hold back only the top corners of the side extensions 214, and may be less efficient because they would use more strapping material due to the distance covered. One of skill in the art will understand that the dimensions of the cardboard ply 210 may be adjusted to accommodate for this, such as by using a cardboard ply 210 with a higher backwall 212 and taller and/or longer bulkhead side extensions 214 that extend further into the container 10.

For example, two options of cardboard ply 210 may be on hand, and selected based on the location of forward eyelets 70F in a given container.

FIG. 11 shows a perspective view of a cardboard ply bulkhead 210 as it is set up inside a container such as that in FIG. 4. However, this ply 210 has an extended bottom stand 216 that extends forward along the container floor 40 past forward eyelets 70F on each side of the container 10 (not shown). As shown here, an additional strap, referred to as forward strap 260, may be installed that runs a loop around the right and left upper eyelets 70R and 70L, down the inside of side extensions 214, around forward eyelets 70F, and over the top of bottom stand 216. By tensioning and sealing the ends of this forward strap 260, the strap will hold bottom stand 216 down against floor 40 and side extensions 214 are out against the container walls 30 in order to minimize or even eliminate dry-flow particles from working their way around or under the bulkhead during transit. Though not shown, the forward strap 260 may be left with an unloaded breakaway end 261 similar to those shown with the other straps. Typically this forward strap would be the first to be installed, even prior to installing the bulkhead, because otherwise the installer would have to climb over the top of the bulkhead to get out of the container.

FIG. 12 shows an alternative embodiment for retaining the side extensions 214 out securely against the container interior walls 30. In this case, two additional straps are used—a left forward strap 265L and a right forward strap 265R. The left and right designations are given based on the perspective of looking into the container 10 through the loading doors 20, so as to be consistent with earlier figures. Here, each of left and right forward straps 265L, 265R route over the upper eyelet on their respective sides, down to the lower eyelets, and then forward in the container to the forward eyelets 70F and back to the upper eyelets, thereby forming two right triangles, one on each side of the container. These straps do not extend across the container.

On the diagonal leg of forward straps 265L, 265R, they pass to the inside of side extensions 214 so as to secure them out against the interior walls 30. On their horizontal leg, they pass outside of the side extensions along the container floor 40 to reach the lower eyelets near the loading doors 30. Alternatively, the straps could be routed over the top of the bottom stand 216 and to the lower eyelets by passing through a small hole formed in each of the corners of the cardboard ply 210, where the backwall, side extensions 214 and bottom stand 216 come together. Finally, on their vertical leg, the left and right forward straps 265L, 265R create reinforcements around which the middle horizontal strap 240 could be wrapped. See, e.g., FIG. 8. This allows more tension to be placed in the middle horizontal strap because, if the forward strap configuration of FIG. 11 is used with the bulkhead securing configuration of FIG. 8, the system would present two tensioned vertical straps along each side of the container at the front of the cardboard ply 210.

In a simpler version of the forward strap configuration of FIG. 12, left and right forward straps could skip the lower eyelet and simply route from the upper eyelet, vertically down around the forward eyelet and back to the upper eyelet, with one strap doing this on each side. Whether this pattern is used, or that in the preceding paragraph, gain there may be a free end left where the straps are joined for use in breakaway. Also again, these straps would preferably be installed before first, then the bulkhead (cardboard ply 210) installed, then the load securing straps (e.g, FIGS. 6-8) installed on the front side of the bulkhead.

While forward straps 260 and 265 described above have been disclosed as separate straps from load securing straps 230L and 230R that cross in front of the bulkhead, in some embodiments these could be formed from a continuous length of strap. While this reduces the steps of tensioning and securing strap ends, it requires work on both sides of the cardboard ply.

FIG. 13 shows a configuration that combines the load securing straps with the forward straps. In this case, the configuration could be used as a standalone solution, and not with one described such as in association with FIGS. 6-8. Here, two separate bracing straps 275 are used, labeled 275L and 275R. These straps follow mirror image patterns on the left and right of the container 10, and overlap to form a double barrier along the base of the cardboard ply 210 where the load is the heaviest. Bracing strap 275L will be described, with the understanding that bracing strap 275R takes a directly opposite path on the other side of the container.

Bracing strap 275L runs around the upper eyelet 70L on the left side of the container, and down to the forward eyelet 70F on the front side of the container. In doing so, as with the configurations in FIGS. 11 and 12, it passes along the interior face of side extension 214, holding it out against the left interior wall 30. Strap 275L then passes along the container floor 40 toward the loading doors 20 until it reaches lower eyelet 70L, still on the left side of the container. From here, it passes across the base of the bulkhead to the right side of the container and around lower eyelet 70R, and then finally back up and across the face of the bulkhead to the upper eyelet 70L on the left side.

Combining bracing strap 275L described above with bracing strap 275R installed in mirror fashion on the other side provides for the cross-straps and double straps along the base of the bulkhead, all for load securement, such as that shown in FIG. 7. But it also provides for side extension 214 securement against the interior walls. Notably this configuration does not provide vertical legs that can be used to install a middle horizontal strap such as shown in FIG. 8. Installing the configuration in FIG. 13 will typically involve first routing the straps around the forward eyelets 70F without securing or tensioning them, then installing the cardboard ply 210, then completing the strap configuration on the front of the bulkhead before tensioning and securing the straps.

Thus, in accordance with a particular embodiment of the present invention, a worker would prepare the intermodal container 10 for shipment in the following manner. First, they would take a ply of custom fit cardboard ply 210 and bend the side 212 and bottom 214 flaps forward, creating a 3-dimensional cup to capture and hold back the grain 100. If a custom fit ply is not available, it could be cut and fitted from a larger ply, so long as it extends across the width of the container 10. The worker would then climb into the container and install a forward strap 260, by routing a strap through left and right upper eyelets 70L, 70R, and down through left and right forward eyelets 70F. The worker would then join the ends of the forward strap 260 using a tensioning tool 300 that friction welds the strap ends together, leaving at least several inches of unloaded strap 261 as a breakaway. Then the worker would position the cardboard ply 210 within the container 10, sliding the side extensions 214 between the forward strap 260 and the interior wall 30 of the container 10 on each side. The worker would then thread a strap (230L) around the upper and lower eyelets 70L on the left side of the container (these being typically the lowest two eyelets on that side adjacent the loading door 20) and around the lowest eyelet 70R on the right side, and then pull the strap ends together in the center. These ends would be joined using the tensioning tool 300, again leaving several inches of unloaded strap 231L as a breakaway. The worker would then perform the same exercise on the other side of the container to create another tension strap 230R, wrapping it around the upper and lower eyelets 70R on the right side and around the lowest eyelet 70L on the left side, and joining its ends in the same manner, again leaving a breakaway end 231R. The worker would then install a middle horizontal strap 240 around the vertical legs of the straps 230L and 230R, sealing this in the middle to form a horizontal strap across the lower portion of the cardboard ply. Once complete, the worker would load the grain into the container at a point beyond the cardboard ply 210 and the grain 100 would compress against the cardboard ply holding it against the strapping configuration. The worker would then install the foot brace 280 at the base of the bulkhead and seal the container loading doors 20 against it, thereby securing the load for shipment.

On the far end, a worker would simply open the loading doors 20, remove the foot brace 280, pull the breakaway straps left by the first worker, and stand back to allow the grain 100 to unload using gravity.

It will be understood by those skilled in the art that various changes may be made and equivalents may be substituted without departing from the scope of systems and methods disclosed in this application. For example, different types of available straps and joining methods could be used than those specifically disclosed, as would be understood to a person of skill in the art, and based on the design constraints provided. Moreover, the specific dimensions of the bulkhead, including height of the ply, length of the folds, and position of the ply forward of the loading doors could be different than shown in the illustrated embodiments without departing from the concepts claimed below and enabled herein. While the ply is described as cardboard, one of skill in the art would recognize that any disposable and relatively rigid material could be used so long as it does not negatively impact the dry-flowable contents, such as, for example, plastic, sheet metal or wood. The selection of material will typically be driven by cost, which may fluctuate making one material more preferable than another from time to time. In addition, many modifications may be made to adapt a particular situation or material to the teachings of the novel techniques without departing from its scope. Therefore, it is intended that the novel techniques not be limited to the particular techniques disclosed, but that they include all techniques falling within the scope of the appended claims.

What is claimed is:

1. A system for maintaining separation between a dry flowable commodity loaded within an intermodal shipping container and loading doors at an end of the intermodal container, the system comprising:

a cardboard ply positioned near the end of the intermodal shipping container and slightly inset from the loading doors, the cardboard ply extending from a left interior wall of the intermodal shipping container to a right interior wall of the shipping container, and extending from a floor of the intermodal shipping container toward a ceiling of the intermodal shipping container;

a first tension strap extending through a first lower eyelet fixed to the left interior wall proximate the floor of the intermodal shipping container and then diagonally across the intermodal container and through a second upper eyelet fixed to the right interior wall at a height at least twelve inches above the first lower eyelet; and a second tension strap extending through a second lower eyelet fixed to the right interior wall proximate the floor of the intermodal shipping container and then diagonally across the intermodal container and through a first upper eyelet fixed to the left interior wall at a height at least twelve inches above the second lower eyelet;

wherein the first tension strap crosses the second tension strap at a point substantially centered between the left interior wall of the intermodal shipping container and the right interior wall of the intermodal shipping container and below an upper edge of the cardboard ply, and wherein the first and second tension straps are positioned between the cardboard ply and the loading doors of the intermodal shipping container such that cutting the first and second tension straps will release dry flowable commodity loaded within the intermodal shipping container.

2. The system of claim 1, wherein the first tension strap extends through the first lower eyelet, the second lower eyelet and the second upper eyelet, thereby forming a first triangle having a vertical leg along the right interior wall of the intermodal shipping container; and, wherein the second tension strap extends through the first lower eyelet, the second lower eyelet and the first upper eyelet, thereby forming a second triangle having a vertical leg along the left interior wall of the intermodal shipping container.

3. The system of claim 2, further comprising a third tension strap extending horizontally across a side of the cardboard ply facing the loading doors, and through both the first lower eyelet and the second lower eyelet.

4. The system of claim 3, further comprising a fourth tension strap extending horizontally across the side of the cardboard ply facing the loading doors at a height approximately midway between the first lower eyelet and the first upper eyelet, wherein the fourth tension strap further extends around both the vertical leg of the first triangle and the vertical leg of the second triangle.

5. The system of claim 1, wherein the cardboard ply further comprises:

a left flap folded forward that seats along the left interior wall of the intermodal shipping container and extends away from the loading doors;

a right flap folded forward that seats along the right interior wall of the intermodal shipping container and extends away from the loading doors; and a bottom flap folded forward that rests on the floor of the intermodal shipping container and extends away from the loading doors.

6. The system of claim 2, further comprising a brace positioned on the floor of the intermodal shipping container just aft of the cardboard ply and approximately centered between the left and right interior walls of the intermodal shipping container such that, when the loading doors are closed, the brace is sandwiched between the loading doors and the cardboard ply.

7. The system of claim 6, wherein the brace is coated with a water-resistant coating.

8. The system of claim 1, wherein each of the first tension strap and the second tension strap have a first end and a second end joined by a friction weld, and are each pulled to a tension exceeding 200 lbs.

9. The system of claim 8, wherein each of the second end of the first tension strap and the second end of the second tension strap have an unloaded portion extending beyond their respective second ends, wherein the unloaded portion may be grasped and pulled in order to weaken the friction weld and help release the dry flowable commodity.

10. The system of claim 9, wherein each unloaded portion has a free end that is friction welded to a tensioned component of the first end of its respective tension strap.

11. A method for maintaining separation between dry flowable commodities loaded within an intermodal shipping container and the loading doors at an end of the intermodal container, the method comprising the steps of:

positioning a cardboard ply near the rear of the intermodal shipping container and slightly inset from the loading doors such that the cardboard ply extends from a left interior wall of the intermodal shipping container to a right interior wall of the shipping container, and extends from a floor of the intermodal shipping container toward a ceiling of the intermodal shipping container;

extending a first tension strap through a first lower eyelet fixed to the left interior wall proximate the floor of the intermodal shipping container and then diagonally across the intermodal container and through a second upper eyelet fixed to the right interior wall at a height at least twelve inches above the first lower eyelet; and extending a second tension strap through a second lower eyelet fixed to the right interior wall proximate the floor of the intermodal shipping container and then diagonally across the intermodal container and through a first upper eyelet fixed to the left interior wall at a height at least twelve inches above the second lower eyelet;

such that the first tension strap crosses the second tension strap at a point substantially centered between the left interior wall of the intermodal shipping container and the right interior wall of the intermodal shipping container and below an upper edge of the cardboard ply, and such that the first and second tension straps are positioned between the cardboard ply and the loading doors of the intermodal shipping container, and such that cutting the first and second tension straps so positioned will release dry flowable commodity loaded within the intermodal shipping container.

12. The method of claim 11, wherein the step of extending the second tension strap further comprises:

extending the second tension strap through the first lower eyelet, the second lower eyelet and the second upper eyelet, thereby forming a first triangle having a vertical leg along the right interior wall of the intermodal shipping container; and, extending the second tension strap through the first lower eyelet, the second lower eyelet and the first upper eyelet, thereby forming a second triangle having a vertical leg along the left interior wall of the intermodal shipping container.

13. The method of claim 12, further comprising the step of extending a third tension strap horizontally across a side of the cardboard ply facing the loading doors, and through both the first lower eyelet and the second lower eyelet.

14. The method of claim 13, further comprising the step of extending a fourth tension strap horizontally across the side of the cardboard ply facing the loading doors at a height approximately midway between the first lower eyelet and the first upper eyelet, wherein the fourth tension strap further extends around both the vertical leg of the first triangle and the vertical leg of the second triangle.

15. The method of claim 11, further comprising the steps of:

folding a left flap of the cardboard ply forward such that it seats along the left interior wall of the intermodal shipping container and extends away from the loading doors;

folding a right flap of the cardboard ply forward such that it seats along the right interior wall of the intermodal shipping container and extends away from the loading doors; and folding a bottom flap forward such that it rests on the floor of the intermodal shipping container and extends away from the loading doors.

16. The method of claim 15, further comprising the steps of:

extending a first forward tension strap from the second upper eyelet fixed to the right interior wall, along an interior face of the right flap, and to a forward eyelet fixed to the right interior wall; and extending a second forward tension strap from the first upper eyelet fixed to the left interior wall, along an interior face of the left flap, and to a forward eyelet fixed to the left interior wall.

17. The method of claim 16, wherein the first forward tension strap and the second forward tension strap combine to form a single, contiguous forward tension strap that extends across a top edge of the cardboard ply and along an upper surface of the bottom flap.

18. The method of claim 11, further comprising the steps of:

pulling first and second ends of the first tension strap together with a force of at least 200 pounds and, while such force is still applied, joining the first and second ends with a friction weld; and, pulling first and second ends of the second tension strap together with a force of at least 200 pounds and, while such force is still applied, joining the first and second ends with a friction weld.

19. The method of claim 18, wherein the first end of the first tension strap is joined to the second end of the first tension strap at a location along the second end such that an unloaded portion remains for use in helping break the friction weld of the first tension strap.

20. The method of claim 19, further comprising friction welding a free end of the unloaded portion to a tensioned component of the first end of the first tension strap.

* * * * *